United States Patent [19]

Brand et al.

[11] 4,062,476

[45] Dec. 13, 1977

[54] ICE DISPENSER WITH ROTATABLE SUPPLY CONTAINER

[75] Inventors: Derek A. Brand, Naperville; Rouben T. Terzian; Douglas P. Montague, both of Chicago, all of Ill.

[73] Assignee: Marvin Glass & Associates, Chicago, Ill.

[21] Appl. No.: 637,709

[22] Filed: Dec. 4, 1975

[51] Int. Cl.[2] ..... B67D 5/64

[52] U.S. Cl. ..... 222/131; 141/361; 222/167

[58] Field of Search ..... 222/167, 411, 367, 146 C, 222/169, 170, 131; 141/360, 361, 362; 62/344

[56] References Cited

U.S. PATENT DOCUMENTS

| | | | |
|---|---|---|---|
| 2,720,340 | 10/1955 | Gustafson | 222/167 |
| 3,093,268 | 6/1963 | Smith et al. | 222/167 |
| 3,319,825 | 5/1967 | Dore | 222/169 X |
| 3,390,537 | 7/1968 | Callen | 62/344 X |
| 3,581,949 | 6/1971 | Conrad | 222/167 |
| 3,874,559 | 4/1975 | Pink | 222/146 C |

*Primary Examiner*—Stanley H. Tollberg

*Assistant Examiner*—Francis J. Bartuska

*Attorney, Agent, or Firm*—Mason, Kolehmainen, Rathburn & Wyss

[57] ABSTRACT

A portable ice dispenser for dispensing cubed or crushed ice from a receptacle into a container, such as a glass or the like, automatically when the glass is placed under a discharge chute on the front of the ice dispenser. The ice dispenser includes a thermally insulated cylindrical ice receptacle which includes a discharge opening in a front wall. The cylindrical receptacle is rotatably mounted about a generally horizontal concentric axis by a frame and includes a drive train for rotating the receptacle about the horizontal axis. An on-off switch is provided below the discharge opening in the receptacle for engagement by a glass placed under the opening which contacts and closes the switch to start the receptacle rotating. A plurality of internal, inwardly radially directed, fins are provided within the receptacle to agitate and carry the ice particles therewith. As the fins reach an uppermost position within the rotating receptacle, some of the ice particles drop onto a discharge chute which projects through the discharge opening to direct the ice particles into the glass.

12 Claims, 7 Drawing Figures

Fig 5
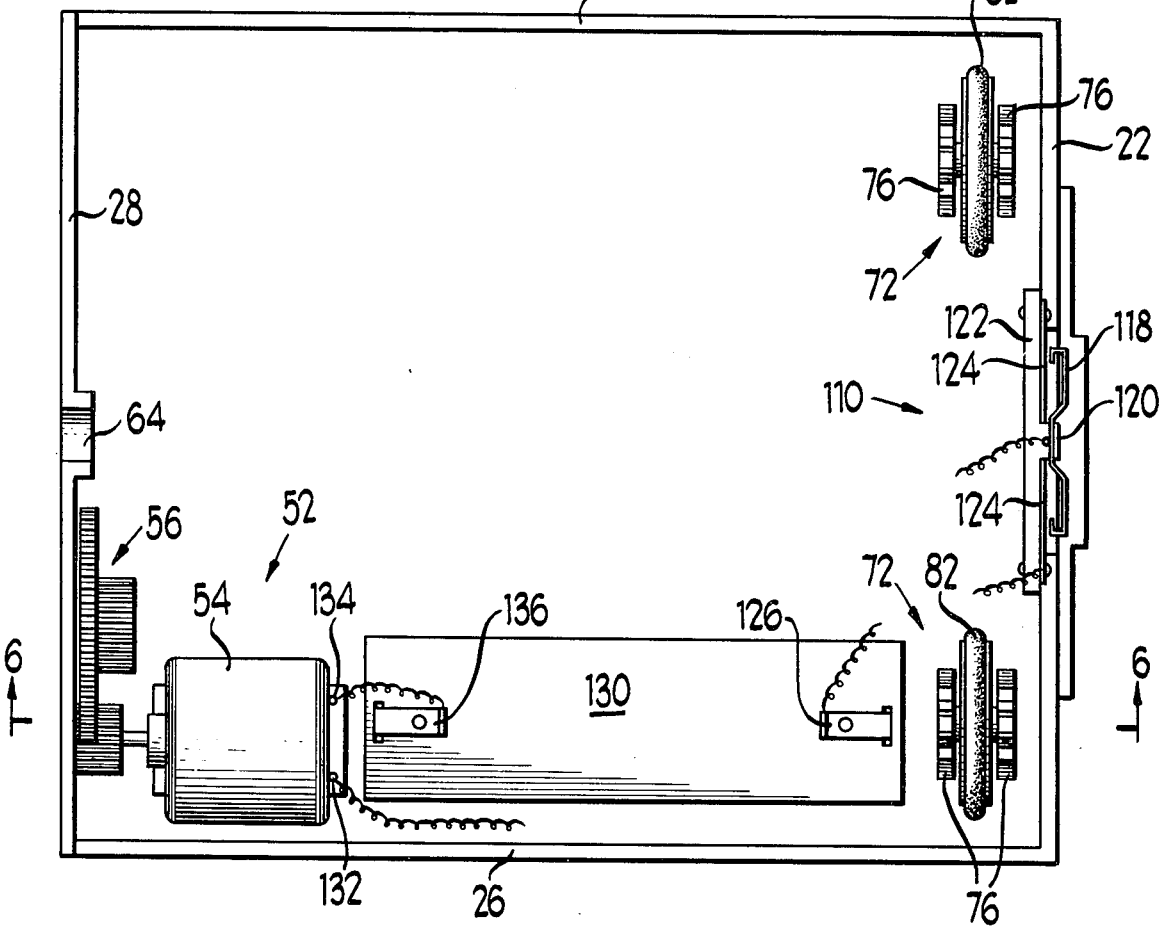
Fig 6
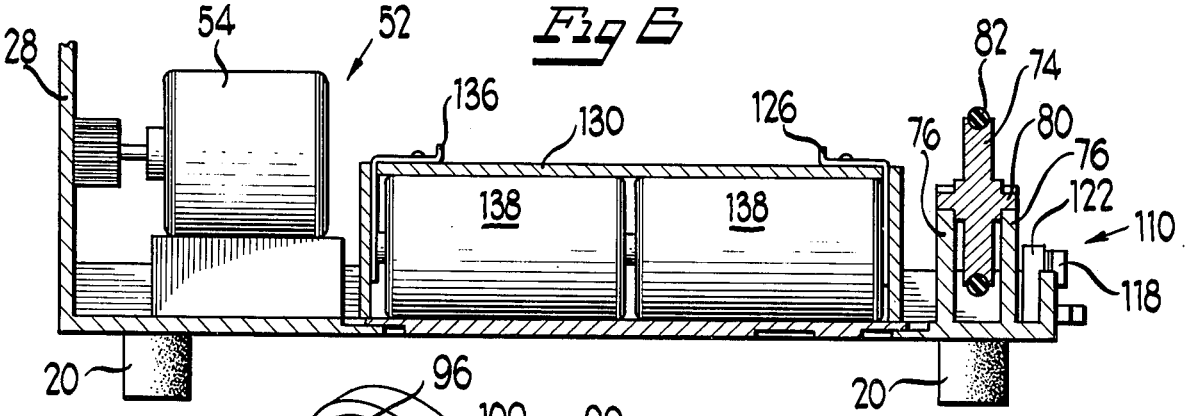
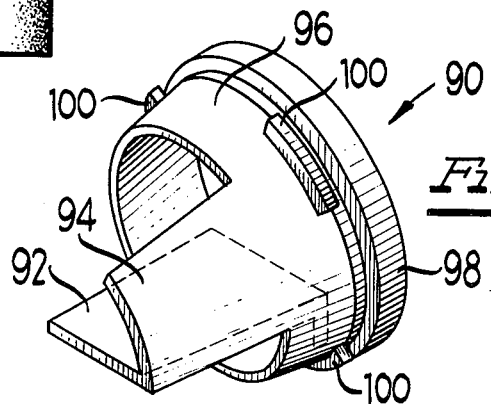
Fig 7

ICE DISPENSER WITH ROTATABLE SUPPLY CONTAINER

BACKGROUND OF THE INVENTION

1. Field of the Invention

This invention relates to ice dispensers and in particular to an economical, portable ice dispenser having an enclosed power supply.

2. Description of the Prior Art

Prior art ice dispensers generally have included a helical auger within a receptacle which acts as a feed device when rotated to discharge ice particles from the dispenser. Most of these dispensers are very elaborate, including many mechanical elements, and are designed primarily for commercial and industrial use. The complex and commercial nature of the prior art devices has therefore made most of them very expensive and therefore undesirable for home or portable use.

SUMMARY OF THE INVENTION

The ice dispenser of the present invention includes a generally rectangular frame having an upstanding front and rear wall portion. A cylindrical receptacle for storing ice particles is rotatably mounted about a generally horizontal concentric axis on the frame and is connected to a drive means for rotation about the horizontal axis.

A discharge opening on the front of the receptacle is aligned with a suitable aperture in the front wall of the housing so that ice particles may exit through the end of the housing into a suitable container, such as a glass. Dispensing means is provided, including at least one radially directed fin on the interior of the receptacle and a dispensing chute removably mounted to the front wall of the frame projecting interiorly of the receptacle. Ice particles are fed thereby from within the receptacle out through the discharge opening and into the container as the receptacle is rotated by the drive means.

BRIEF DESCRIPTION OF THE DRAWINGS

FIG. 5 is a partially fragmented, horizontal section taken generally along the line 5—5 of FIG. 2;

FIG. 6 is a fragmented vertical section taken generally along the line 6—6 of FIG. 5; and FIG. 7 is an enlarged rear perspective view of the dispensing chute which is mounted on the front of the ice dispenser.

DESCRIPTION OF THE PREFERRED EMBODIMENT

Figure 1:
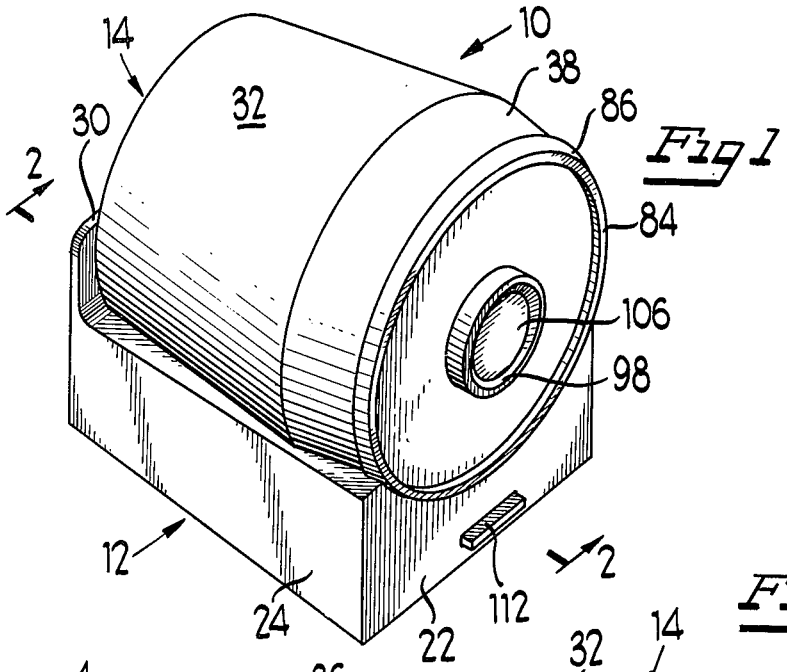
FIG. 1 is a perspective view of the ice dispenser contemplated by the present invention.

The ice dispenser of the present invention, generally designated 10, is shown in perspective in FIG. 1. The ice dispenser includes a generally rectangular base 12 and a rotatably mounted generally cylindrical ice receptacle 14 mounted on the base.

Figure 2:
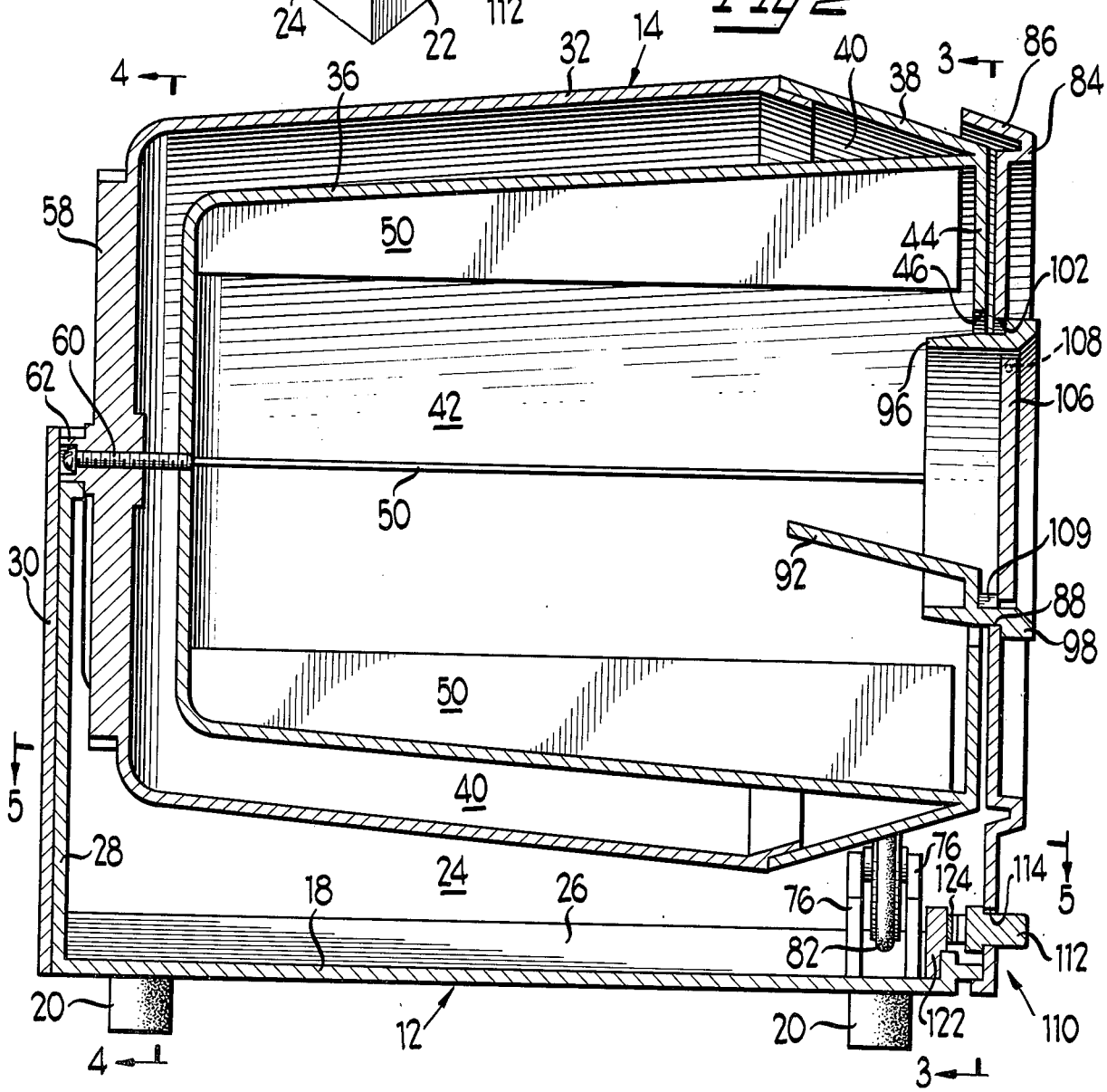
FIG. 2 is a vertical section, on an enlarged scale, of the ice dispenser taken generally along the line 2—2 of FIG. 1.

Referring to FIG. 2, the base 12 includes a generally flat bottom plate 18 which is supported by a plurality of legs 20 on any suitable supporting surface. A generally circular shaped front wall 22 is integrally molded with a pair of upstanding side walls 24 (FIG. 4) secured to the base plate 18 by a pair of vertical flanges 26 along the side edges thereof. A rear wall 28 (FIGS. 2 and 4) is integrally molded with the base plate 18 and is covered by a rear face plate 30. The front, side and rear walls of the housing define an enclosure for mounting several other components of the invention, to be described in detail hereinafter.

The ice receptacle 14 includes a tapered cylindrical outer shell 32 into which a similarly shaped smaller inner shell 36 is inserted and maintained by a top frusto-conical flange 38. The air space between the outer and inner shell 32 and 36 and between the frusto-conical portion 38 and the inner shell 36 provides insulation to reduce the amount of heat transfer from the enviroment to an inside receptacle cavity 42 which stores ice particles. An annular front wall 44 is integrally molded or otherwise attached to the inner shell 38 to provide a circular discharge opening 46 for the removal of ice from within the cavity 42.

Figure 3:
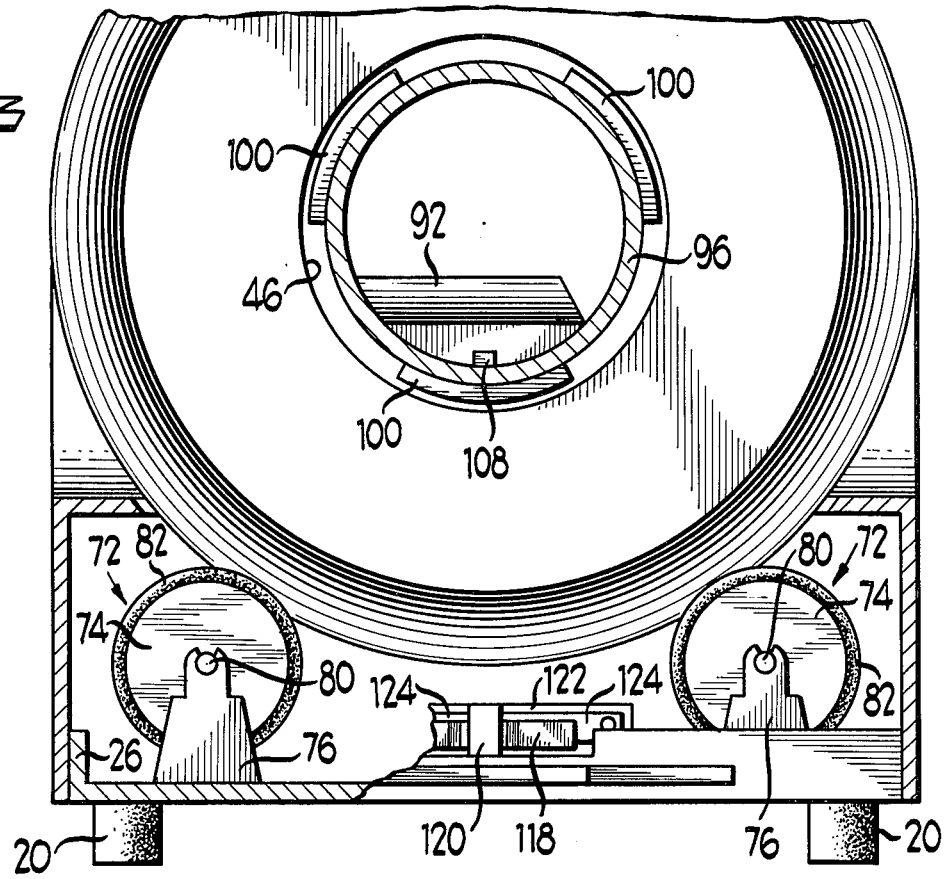
FIG. 3 is a fragmented vertical section, on an enlarged scale, taken generally along the line 3—3 of FIG. 2.
Figure 4:
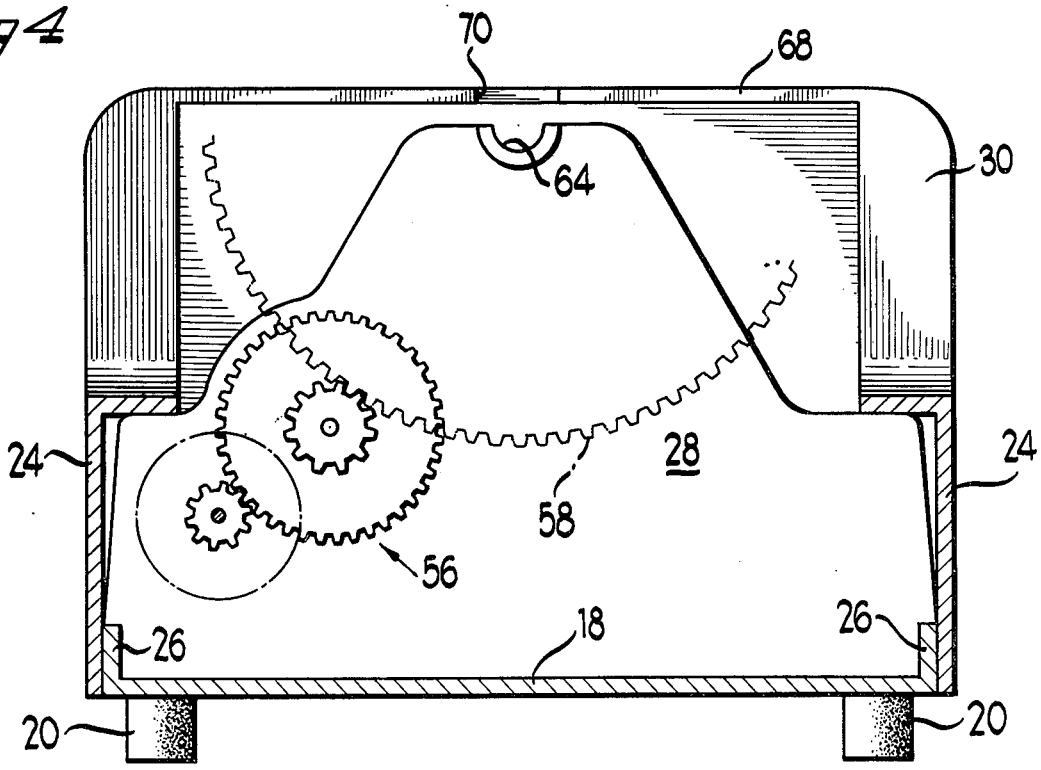
FIG. 4 is a fragmented vertical section taken generally along the line 4—4 of FIG. 2.

Four radially directed, longitudinal fins 50 are equally spaced about the cylindrical walls of the cavity 42 to move the ice particles therewith during rotation. A drive means, generally designated 52 (FIGS. 5 and 6), is provided to rotate the receptacle 14. More particularly, the drive means 52 includes an electric motor 54 connected by a gear train, generally designated 56, to a large gear 58 formed integrally with or mounted on a rearward wall of the outer shell portion 32, as by a screw 60 (FIG. 2). A journal portion 62 is provided on the gear 58 to rotatably mount the rear of the receptacle 14 in a semi-circular bearing 64 as best seen in FIG. 4. The rear face plate 30 on the end of the housing includes a forwardly directed top peripheral flange thereacross which is provided with a notch 70 to facilitate insertion of the journal 62 into the bearing 64. The forward end of the receptacle 14 is mounted by a pair of rollers, generally designated 72 (FIGS. 3 and 5). Each roller includes a wheel 74 which is rotatably mounted by a pair of journal bearing flange supports 76 for free rotation about its reduced ends 80. A peripheral friction surface 82 is provided on each wheel 74 for engagement with the frustoconical section 38 to rollably and rotatably mount the forward end of the receptacle 14.

The front wall 22 of the housing 12 includes a generally circular upper portion 84 which includes a rearwardly directed frusto-conical flange portion which is generally parallel with the frusto-conical portion 38. A circular opening 88 is provided in the center of the front wall circular portion 84 generally in axial alignment with the discharge opening 46 of the top of the receptacle 14.

A discharge chute and mounting device, generally designated 90 (FIG. 7), is provided to direct ice particles out of the cavity 42. The discharge chute includes a rearwardly canted flat portion 92 and an arcuately shaped guide surface 94 which project into the cavity 42 through the discharge opening 46. The flat portion 92 and the guide surface 94 are mounted to a generally frusto-conical ring 96 mounted to a front clamp ring 98. A plurality of arcuate flanges 100 are provided on the frusto-conical surface 96, spaced rearwardly from the clamp ring 98. A similar plurality of arcuate cutouts 102 are provided about the periphery of the wall aperture 88 so that the chute 90 can be inserted through the aperture 88 and turned to clamp the dispensing chute 90 on the front wall 22 of the housing. When in its clamped position, as shown in FIGS. 1 and 2, the chute 92 and guide surface 94 project into the interior of the cavity 42 so that, as the receptacle 14 is rotated by the drive means 72, a portion of the ice particles which are lifted by the fins 50 will fall onto the surface of the chute 92 and be directed outwardly through the front wall 22 of the housing.

A circular door 106 is pivotally mounted by a pin 108 within the center of the clamp ring 98 and is automatically opened as ice particles slide down the chute 92. A stop tab 109 is provided at the front end of the chute surface 92 to maintain the pivotal door 106 in a vertical orientation.

Selectively operable on-off means, generally designated 110 (FIGS. 2, 3, 5 and 6), is provided to actuate the drive means 52. More particularly, the on-off means 110 includes a push bar 112 mounted within a rectangular slot 114 in the front wall 22 directly below the discharge chute 90. The bar 112 engages an electrically conductive strip 118 mounted by a generally vertical flange 120 on a rear mounting member 122. The rear mounting member 122 also mounts a pair of electically conductive strips 124 which are normally out of engagement with the strip 118. The strip 118 is connected to one terminal 126 of a battery housing 130. The other strip 124 is connected to one of the terminals 132 of the motor, and the other terminal 134 of the motor is connected to a complementary battery terminal 136. A pair of batteries 138 within the housing 130 supply the power for the drive means motor 54. Depressing of the push bar 112 completes the circuit between the battery and the drive means to operate the ice dispenser and continually rotate the receptacle while the contact is maintained. The position of the push bar 112 is located directly under the discharge opening 46 so that an appropriate container, such as a glass, can be used to actuate the push bar 112 while it also is in position for receiving the dispensed ice particles.

The foregoing detailed description has been given for clearness of understanding only and no unnecessary limitations should be understood therefrom as some modifications will be obvious to those skilled in the art.

We claim:

1. An ice dispenser comprising:

a frame;

an insulated housing having a frusto-conical interior receptacle for storing pre-frozen ice particles;

a front circular wall provided on the larger end of said frusto-conical receptacle having a discharge opening therein;

means rotatably mounting said housing and receptacle on the frame for rotation about a generally horizontal axis;

drive means connected to said receptacle for rotating said housing and receptacle about said horizontal axis; and dispensing means including a plurality of radially directed longitudinally extending fins on the interior of said receptacle, each fin including a portion thereof adjacent said front wall and a stationary deflector mounted on the frame for projecting through said discharge opening into the interior of said receptacle, said deflector comprising an upwardly directed chute for deflecting moving ice particles outwardly of said receptacle through said discharge opening.

2. The ice dispenser of claim 1 including selectively actuatable on-off means associated with said drive means to permit selective dispensing of ice particles from said receptacle, said on-off means comprises a pushbutton mounted below said discharge opening, said pushbutton being actuated by contact with a container when placed in a position below the discharge opening for receiving dispensed ice particles.

3. The ice dispenser of claim 2 wherein said drive means includes an electric motor, and portable power supply, said on-off means being connected therewith to permit selective actuation of said drive means.

4. The ice dispenser of claim 1 wherein said rotatable mounting means comprises means for removably mounting said housing on the frame, said removable mounting means including a pair of support rollers mounted on the frame adjacent the front wall of said receptacle and a rotational support shaft on the rear wall of said receptacle for mounting within a bearing on the frame.

5. The ice dispenser of claim 1 wherein said deflector is removably mounted in a suitable aperture formed on the frame in alignment with said discharge opening of the receptacle to facilitate removal of the housing from the frame for refilling thereof with ice particles.

6. The ice dispenser of claim 1 wherein said drive means includes a relatively large gear secured to the rear wall of said receptacle, said gear being in a driving relationship with said drive means.

7. The ice dispenser of claim 1 wherein said deflector comprises a chute portion extending generally upwardly through the discharge opening generally along the bottom edge thereof to deflect ice particles falling from the forward edge of the fins through the opening.

8. A portable dispensing device, comprising:

a frame;

a housing having a frusto-conical interior receptacle for receiving and storing particulate matter;

a front circular wall provided on the larger end of said frusto-conical receptacle, said front wall having a discharge opening therein;

means removably and rotatably mounting said housing and receptacle on the frame for rotation about a generally horizontal axis, said means comprising a pair of support rollers mounted on the frame adjacent the front wall of said receptacle and a support shaft on the rear wall of said receptacle for mounting within a bearing on the frame;

drive means connected to said receptacle for rotating the housing and receptacle about a horizontal axis;

selectively actuatable on-off means associated with said drive means, said on-off means comprising a push-button mounted below said discharge opening, said pushbutton being actuatable by contact with a container when placed in a position below the discharge opening for receiving dispensed particles; and dispensing means including a plurality of radially directed, longitudinally extending fins on the interior of said receptacle, each fin including at least a portion thereof generally adjacent said front wall, and a stationary deflecting chute mounted on the frame for extending generally upwardly through the discharge opening along the bottom edge thereof into the interior of said receptacle for deflecting particles falling from the forward edge of the ribs through the discharge opening as said housing and receptacle are rotated by the drive means.

9. A dispenser comprising:

a frame;

a housing defining an interior receptacle for storing particles, said receptacle being tapered from a closed end having a predetermined transverse cross sectional area to a discharge end having a larger transverse cross sectional area;

a front wall having a discharge opening therein provided on the larger end of said tapered receptacle;

means mounting said housing and receptacle on the frame for rotation about a generally horizontal axis; and dispensing means including at least one generally radially directed inwardly extending agitating member on the interior of said receptacle, said member including at least a portion thereof adjacent said front wall and a stationary deflector mounted on the frame for projecting through said discharge opening into the interior of said receptacle, said deflector comprising an upwardly directed chute portion for deflecting agitated particles outwardly of said receptacle through the discharge opening in the front wall as said housing is rotated.

10. The dispenser of claim 9 including drive means for rotating said housing and selectively actuatable on-off means associated with said drive means to permit selective dispensing of ice particles from said receptacle, said on-off means comprising a pushbutton mounted below said discharge opening, said pushbutton being actuated by contact with a container when placed in a position below the discharge opening for receiving dispensed ice particles.

11. The dispenser of claim 10 wherein said drive means includes a relatively large gear secured to the closed end of said housing, said gear being in driving relationship with said drive means.

12. The dispenser of claim 9 wherein said deflector on the frame comprises a deflecting chute removably mounted in a suitable aperture on the frame in alignment with the discharge opening in the front wall of said housing.

* * * * *